US005346016A

United States Patent [19]

Wilson et al.

[11] Patent Number: 5,346,016

[45] Date of Patent: Sep. 13, 1994

[54] APPARATUS AND METHOD FOR CENTRALIZING PIPE IN A WELLBORE

[75] Inventors: Dennis R. Wilson; Jack H. Cole, both of Ponca City; Wilber R. Moyer, Blackwell; Larry K. Moran, Ponca City, all of Okla.

[73] Assignee: Conoco Inc., Ponca City, Okla.

[21] Appl. No.: 51,032

[22] Filed: Apr. 20, 1993

Related U.S. Application Data

[63] Continuation-in-part of Ser. No. 761,210, Sep. 16, 1991, Pat. No. 5,228,518.

[51] Int. Cl.[5] ..... E21B 17/10

[52] U.S. Cl. ..... 166/380; 166/212; 166/241.1; 166/242; 166/383

[58] Field of Search ..... 166/242, 241.6, 376, 166/369, 382, 383, 100, 296, 212, 241.1, 55.1, 297, 299, 380; 175/2, 4.53

[56] References Cited

U.S. PATENT DOCUMENTS

| | | | |
|---|---|---|---|
| 1,432,649 | 10/1922 | Wessels . | |
| 2,178,845 | 11/1939 | Baker . | |
| 2,253,415 | 8/1941 | Brodie . | |
| 2,654,435 | 10/1953 | Oliver et al. . | |
| 2,707,997 | 5/1955 | Zandmer et al. . | |
| 2,743,781 | 5/1956 | Lane | 166/212 |
| 2,775,304 | 12/1958 | Zandmer . | |
| 2,855,049 | 10/1958 | Zandmer | 166/100 |
| 2,874,783 | 2/1959 | Haines | 166/212 |
| 2,913,051 | 11/1959 | Lister . | |
| 3,120,268 | 2/1964 | Caldwell | 166/100 |
| 3,131,759 | 5/1964 | De Roehemont | 166/212 |
| 3,245,472 | 4/1966 | Zandmer | 166/100 |
| 3,326,291 | 6/1967 | Zandmer . | |
| 3,347,317 | 10/1967 | Zandmer . | |
| 3,358,770 | 12/1967 | Zandmer . | |
| 3,395,758 | 8/1968 | Kelly . | |
| 3,448,805 | 6/1969 | Brown | 166/212 |
| 3,603,391 | 9/1971 | Yann | 166/212 |
| 3,924,677 | 12/1975 | Prenner et al. . | |
| 4,157,732 | 6/1979 | Fonner | 166/315 |
| 4,286,662 | 9/1981 | Page, Jr. | 166/317 |
| 4,498,543 | 2/1985 | Pye et al. | 166/376 |

FOREIGN PATENT DOCUMENTS

| | | |
|---|---|---|
| 0287735 | 3/1987 | European Pat. Off. . |
| 1233801 | 8/1967 | Fed. Rep. of Germany . |
| 8503371 | 7/1987 | Netherlands . |

*Primary Examiner*—Hoang C. Dang
*Attorney, Agent, or Firm*—John E. Holder

[57] ABSTRACT

A system for centralizing casing pipe in a wellbore includes lateral pistons in the side wall of the casing string which are movable by forces applied to their inner end, from a retracted position within the maximum exterior profile of the casing pipe string to a predetermined extended position which will move the casing pipe string toward a central position in the borehole. Various well operations can be performed using the pistons in addition to the centralizing function.

21 Claims, 5 Drawing Sheets

APPARATUS AND METHOD FOR CENTRALIZING PIPE IN A WELLBORE

BACKGROUND AND SUMMARY OF THE INVENTION

This application is a continuation in part of U.S. Pat. application Ser. No. 761,210 filed Sep. 16, 1991, now U.S. Pat. No. 5,228,518.

1. Field of the Invention

This invention relates to centralizing pipes away from the sides of a wellbore and more particularly to centralizing pipes such as well casing in a borehole utilized in recovering fluids from earth formations.

2. Background of the Invention

In the process of establishing an oil or gas well, the well is typically provided with an arrangement for selectively excluding fluid communication with certain zones in the formation to avoid communication with undesirable fluids. A typical method of controlling the zones with which the well is in fluid communication is by running well casing down into the well and then sealing the annulus between the exterior of the casing and the walls of the wellbore with cement. Thereafter the well casing and cement may be perforated at preselected locations by a perforating gun or the like to establish fluid communication with product bearing zones in the formation. The cement also prevents the fluids in adjacent zones which are otherwise sealed from the zone of interest by a shale, a fault, or other geological condition from bypassing the geological seal by moving along the wellbore or well casing. Unfortunately, if the casing is not centered in the wellbore and is in contact with the walls of the wellbore, those portions of the casing string do not get surrounded by cement and thus do not seal the wellbore from migrating fluids. It may be desirable for other reasons to center a pipe string or otherwise space a pipe string from the walls of a borehole such as to facilitate perforating into the borehole.

A number of devices, which are typically called centralizers, have been developed to space the pipe string from the walls of the wellbore. An example of a typical centralizer is a bow spring centralizer which comprises a plurality of elongate spring metal strips which bow outwardly from the pipe string. The bow springs are typically provided at the collars of the well casing in sets to push the casing away from the walls of the wellbore. However, during installation of the string into the wellbore the bow springs create substantial frictional forces reducing the potential reach of a well. Also, the bow springs are somewhat fragile and subject to failure.

Another example of a centralizer for cementing operations is U.S. Pat. No. 2,654,435 issued on Oct. 6, 1953 to Oliver. The Oliver device comprises a shoe attached to the end of the casing string wherein the shoe includes bow springs which are held in a collapsed position by a stem extending through the wall of the shoe to an interior retainer. When the string is in the desired position in the wellbore, the casing string is pressurized to force a plug from an aperture in the end of the shoe. The plug is connected to the retainer which releases from the stem when the plug is forced from the aperture which releases the bow springs to centralize the casing. As an alternative arrangement two or more shoes could be installed in the same string with the retainers connected along a shaft to the end plug. Clearly, this system comprises a complicated deployment apparatus which may be subject to failure or premature deployment. Moreover, it would be impractical for a large number of centralizing shoes to be installed in a casing string which may be necessary in a horizontal well since it must rely on the one plug.

A series of patents has issued to Zandemer and others which involve sleeves extendable by hydraulic force to provide a conduit between the borehole wall and a casing or the like. These sleeves may be extended prior to cementing and then typically have portions that are dissolved by acid or the like after the cement is set to provide a flow path from earth formations into a pipe. These patents include U.S. Pat. Nos. 2,707,947; 2,855,049; 3,326,291; 3,347,313, 3,358,770, 2,775,304, 3,347,317 to Zandemer; and 3,924,677 to Prenner et al. The devices shown in these patents have various drawbacks that render them unacceptable for the situation presented in this application. For example, these devices do not provide a centralizer that will actually force the pipe to the center of the hole, but for the most part, the sleeves are extended until they engage the borehole and at that point they are locked in place. In most cases, nothing insures that each sleeve will extend to a fixed predetermined position. In addition, these devices for the most part do not have pistons with an outer end that resides within the maximum exterior profile of the pipe string. In addition, many of these devices also do not leave a full opening in the casing string when the sleeves are extended to allow devices to be run through the pipe string.

Accordingly, it is an object of the present invention to provide a new and improved method and apparatus for centralizing pipes in a wellbore which overcomes or avoids the above noted limitations and disadvantages of the prior art.

It is a further object of the present invention to provide a method and apparatus for fixedly spacing a pipe string from the walls of a wellbore which includes an extendable piston that remains within the maximum exterior profile of the pipe string while the pipe string is moved into and through the wellbore, including horizontal boreholes.

It is an additional object of the present invention to provide a method and apparatus for spacing a pipe from the walls of a wellbore by using extendable pistons that move when extended to a predetermined fixed position wherein the pistons are clear of the bore of the pipe string when the pistons are extended. Also the centralizing pistons may subsequently be used for fluid communication between the pipe and the formation, or for facilitating other borehole operations such as perforating, fracturing and treating.

SUMMARY OF THE INVENTION

The above and other objects and advantages of the present invention have been achieved in the embodiments illustrated herein by the provision of an apparatus comprising a piston for being mounted in an opening in the peripheral wall of the pipe and for extending generally radially outwardly from the pipe to contact the wall of the wellbore and move the pipe away therefrom. The piston is deployed from a retracted position which is generally within the maximum exterior profile of the pipe to a fixed predetermined extended position wherein the piston extends generally radially from the opening to contact the wall of the wellbore. In the extended position, the piston is substantially clear of the pipe bore to render the pipe full open. Deployment of the pistons is generated with a force such that the piston moves the pipe away from the wall of the wellbore. A securing arrangement is provided for securing the piston in the predetermined fixed extended position to hold the pipe away from the wall of the wellbore.

BRIEF DESCRIPTION OF THE DRAWINGS

Some of the objects and advantages of the invention have been stated and others will become apparent as the description proceeds when taken in conjunction with the accompanying drawings in which.

DETAILED DESCRIPTION OF THE PREFERRED EMBODIMENTS

Figure 1:
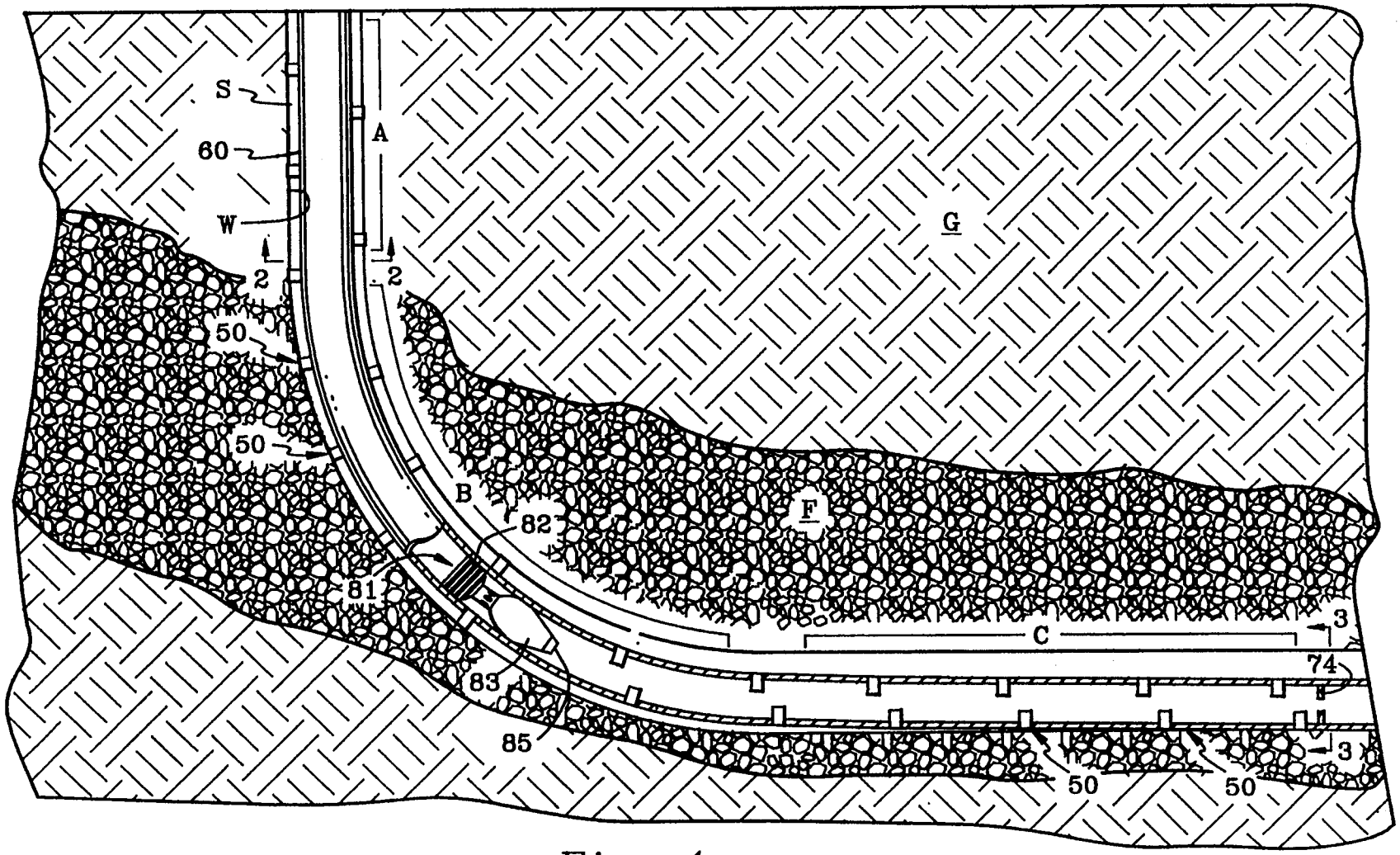
FIG. 1 is a cross sectional view of a wellbore in the ground with a casing string therein spaced from the walls of the wellbore by a plurality of downhole activated centralizers embodying the features of the present invention.

Referring more particularly to the drawings, FIG. 1 illustrates a wellbore W which has been drilled into the ground G. Such wells are often drilled for the exploration and production of hydrocarbons such as oil and gas. The illustrated wellbore W, in particular, includes a generally vertical section A, a radial section B leading to a horizontal section C. The wellbore W has penetrated several formations, one or more of which may be a hydrocarbon bearing zone. Moreover, the wellbore W was particularly drilled to have a horizontal section C which has a long span of contact with a particular zone of interest which may be a hydrocarbon bearing zone. With a long span of contact within a pay zone, it is likely that more of the hydrocarbon present will be produced. Unfortunately, there are adjacent zones which have fluids such as brine that may get into the production stream and thereafter have to be separated from the hydrocarbon fluids and disposed of at additional cost. Accordingly, fluid communication with such zones is preferably avoided.

To avoid such communication with non-product bearing zones, wellbores are typically cased and cemented and thereafter perforated along the pay zones. However, in the highly deviated portions of a wellbore such as the radial section B and the horizontal section C of the illustrated wellbore W, the casing tends to lay against the bottom wall of the wellbore, thereby preventing cement from encircling the casing and leaving a void for such wellbore fluids as brine to travel along the wellbore and enter the casing far from the formation from which it is produced. In the illustrated wellbore W, a casing string or liner 60 has been run therein which is spaced from the walls of the wellbore W by a plurality of downhole activated pistons, generally indicated by the number 50, which serve to centralize the casing. The downhole activated pistons or centralizers 50 are retracted into the casing 60 while it is being run into the wellbore W. Once the casing 60 is suitably positioned in the wellbore W, the centralizers 50 are deployed to project outwardly from the casing as illustrated in FIG. 1. The centralizers 50 move the casing from the walls of the wellbore if the casing 60 is laying against the wall or if the casing is within a predetermined proximity to the wall of the wellbore W. This movement away from the walls of the wellbore will thereby establish an annular free space around the casing 60. The centralizers 50 maintain the spacing between the casing 60 and the walls of other wellbore W while cement is injected into the annular free space to set the casing 60. Thereafter, the well may be managed like any other well. The pistons are latched in an extended position and will thereby maintain the casing 60 centered even if the casing is not cemented as is the case in some completions.

Figure 3:
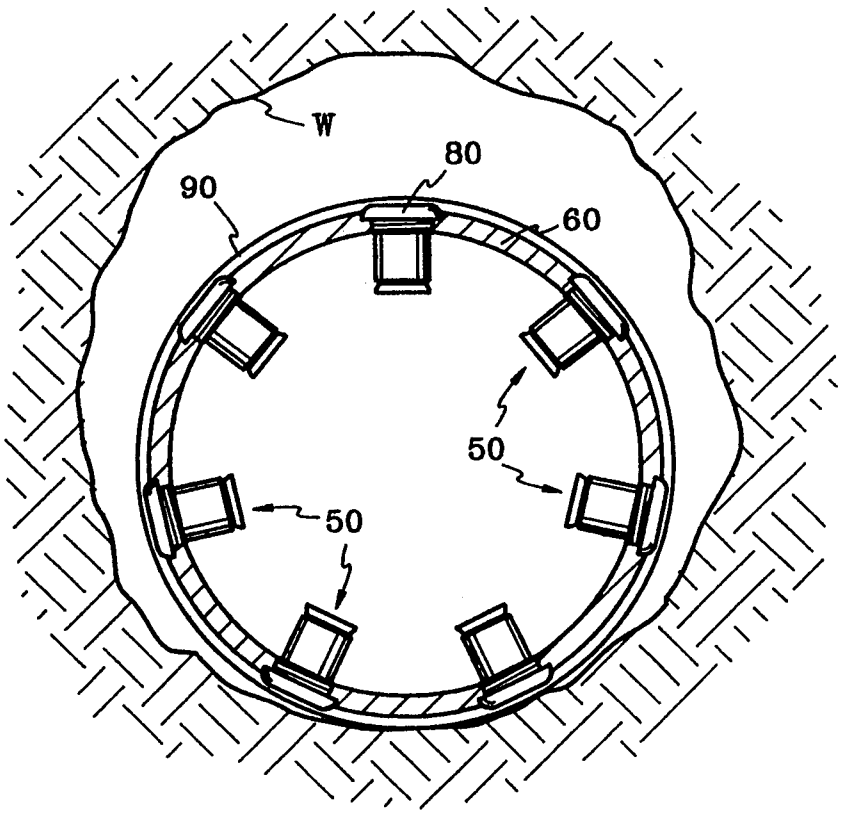
FIG. 3 is a cross sectional end view similar to FIG. 2 prior to the casing being centralized and with the downhole activated centralizers in the retracted position.
Figure 2:
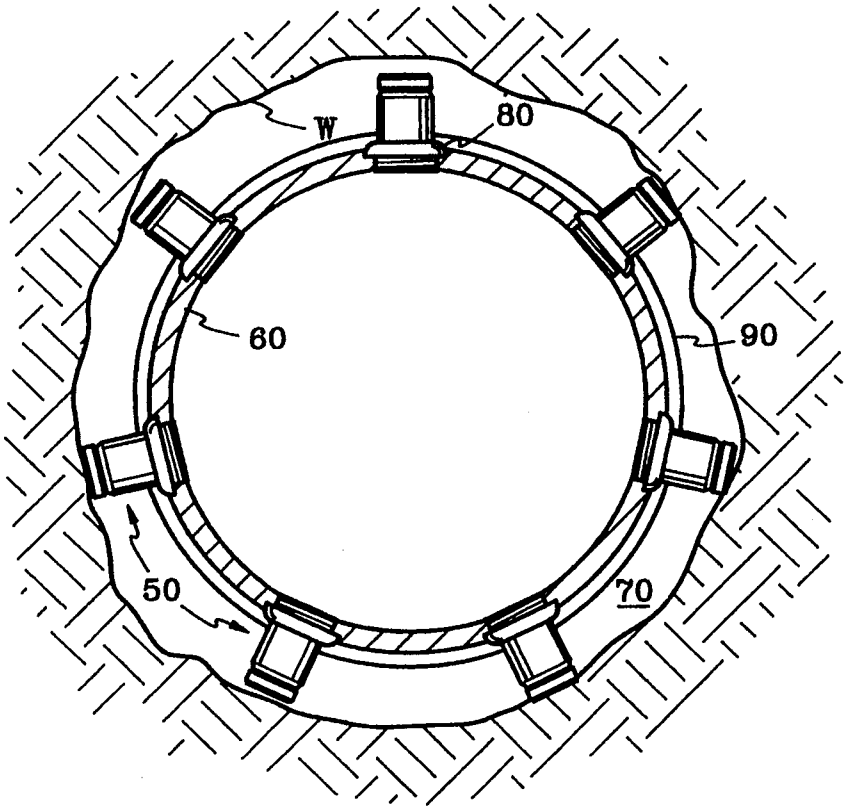
FIG. 2 is an enlarged cross sectional end view of the casing taken along Line 2—2 in FIG. 1.

The centralizers 50 are better illustrated in FIGS. 2 and 3 wherein they are arranged in the extended and retracted positions, respectively. Referring specifically to FIG. 2, seven centralizers 50 are illustrated for supporting the casing 60 away from the walls of the wellbore W, although only four are actually contacting the walls of the wellbore W. It should be recognized and understood that the centralizers work in a cooperative effort to centralize the casing 60 in the wellbore W. The placement of the centralizers 50 in the casing 60 may be arranged in any of a great variety of arrangements. In particular, it is preferred that the centralizers 50 be arranged to project outwardly from all sides of the periphery of the casing 60 so that the casing 60 may be lifted away from the walls of the wellbore W no matter the rotational angle of the casing 60. In some situations it is preferred that the centralizers 50 be regularly spaced along the casing 60 so that the entire length of the casing 60 is centralized. In other situations it is sufficient to center the pipe or casing string at collars or pup joints between pipe sections as will hereinafter be described.

Referring again to FIGS. 2 and 3, the centralizers 50 are mutually spaced around the casing 60 assuring that the orientation of the casing 60 in the wellbore W will not undermine the cumulative effect of the centralizers 50 to centralize the casing 60. As the casing 60 is centralized, an annular space 70 is created around the casing 60 within the wellbore W. The casing 60 is run into the wellbore W with the centralizers 50 retracted as illustrated in FIG. 3, which allows substantial clearance around the casing 60 and permits the casing 60 to follow the bends and turns of the wellbore W. Such bends and turns particularly arise in a highly deviated or horizontal well. With the centralizers 50 retracted, the casing 60 may be rotated and reciprocated to work it into the suitable position within the wellbore. Moreover, the slim dimension of the casing 60 with the centralizers 50 retracted (FIG. 3) may allow it to be run into wellbores that have a narrow dimension or that have narrow fittings or other restrictions.

In FIGS. 2 and 3 and in subsequent Figures as will be explained below, some embodiments of the centralizers 50 present small bulbous portions 80 on the outside of the casing 60 which serve as a means to make the casing wall thicker at that point. It is preferable not to have any dimension projecting out from the casing to minimize drag and potential hangups while moving the string, however as will be discussed below, the bulbous portions 80 are utilized in some embodiments especially in smaller diameter casing such as is often used in horizontal holes when they are cased. It should also be recognized that the bulbous portions 80 are rounded to slide better along the walls of the wellbore W and that the casing string 60 will include collar sections 90 that will extend out radially farther than the bulbous portions (see FIG. 3). Thus, the collar sections 90 present the maximum outer profile of the casing string even when the bulbous portions are present. The outward projection of the retracted centralizers 50 being within the maximum outer profile of the casing string 60 is believed to minimize any problem of running the casing.

Figure 4:
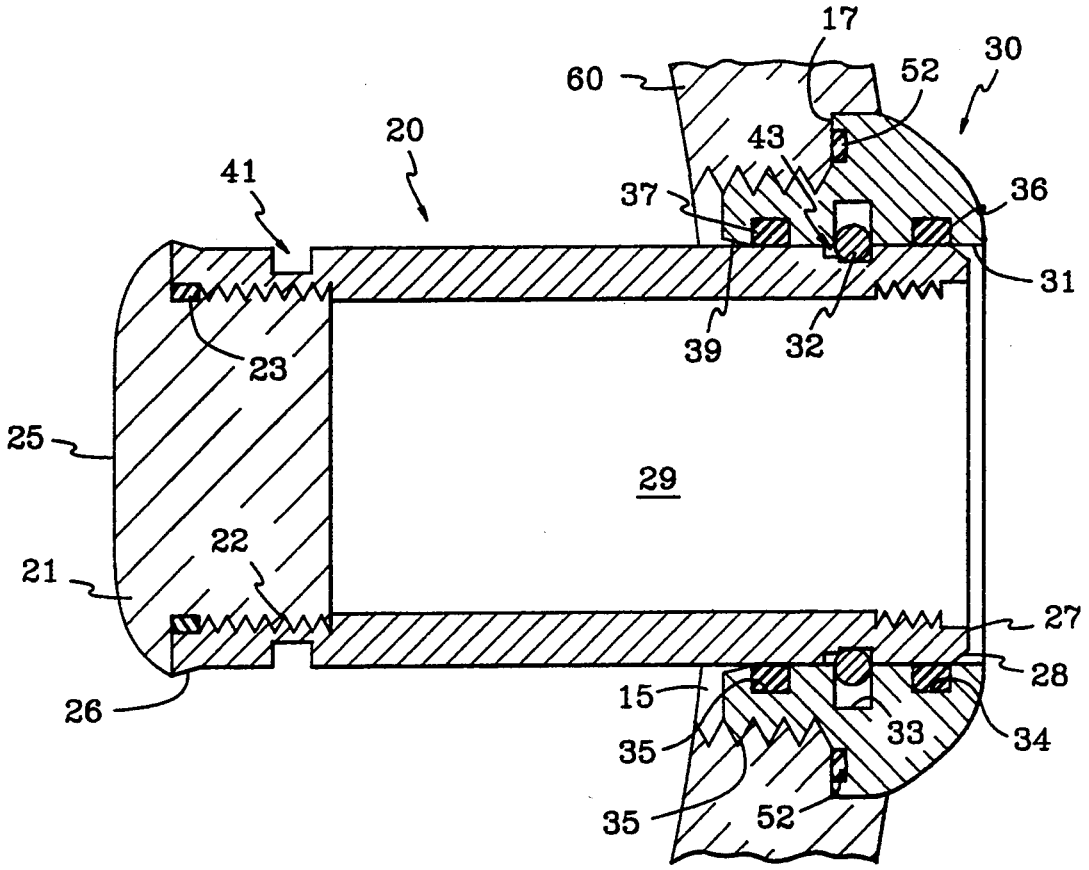
FIG. 4 is an enlarged fragmentary cross sectional view of a downhole activated centralizer mounted in a pipe wall.

The centralizer pistons may take many forms and shapes as is illustrated in Applicant's copending U.S. application Ser. No. 761,210, now U.S. Pat. No. 5,228,518. A centralizer of the present invention is illustrated in FIG. 4 comprising a piston 20 and a piston guide or button 30 mounted in an opening 15 in the casing 60. The piston 20 is a generally cylindrical tube which can be solid or hollow as shown having an internal passageway 29 therein. The piston guide 30 is a slightly larger and shorter tubular element having a hole 31 therein for receiving the piston 20. The piston guide is secured in the opening 15 by screw threads such that it does not extend into the interior of the casing 60 but has a bulbous portion extending outwardly of the casing 60. An O-ring 52 provides a pressure tight seal between the piston guide 30 and the casing 60. In order to accommodate seating of a piston guide comprised of a button 30 in the casing wall, the outer surface of the casing may be spot faced where the hole or opening 15 is formed. An inner face 17 of button 30 then abuts with the spot face. The O-ring 52 is positioned in this face 17.

The piston 20 is arranged for axial movement through the button 30 from a retracted position, in which it is illustrated, to an extended position, such as shown in FIG. 2. The piston 20 and the button or piston guide 30 are mounted in the casing 60 so that their axes are collinear and directed outwardly, preferably radially outwardly, with respect to the axis of the casing 60.

The piston 20 includes a plug 21 secured in the passageway 29 by screw threads 22. The plug 21 shown does not fill the entire passageway 29, but is rather approximately the thickness of the casing 60. Pistons which have other functions may have plugs with a thin wall or no plug. The plug is preferably made of a soft material such as aluminum so that its dome shaped end 25 which faces into the casing bore is deformable under force. An O-ring 23 provides a pressure tight seal between the piston 20 and the plug 21. The piston 20 has the dome shaped inner end 25 and a distal end 27. At the inner end 25, the outer peripheral edge 26 is tapered outwardly, forming the broadest portion of the piston 20. At the distal end 27, the outer peripheral edge 28 is chamfered or tapered inwardly to ease the installation of the piston 20 into the button 30 as will be discussed below.

The piston 20 is slidably mounted in the central hole 31 in the button 30 and is shown retained in a retracted or running position by a snap ring 32. The snap ring 32 is located in a snap ring groove 33 formed in the interior wall of the hole 31 in button 30.

The piston 20 includes two radial piston grooves 41, and 43 formed in the exterior surface thereof. Retaining or running groove 43 is shown in greater detail in FIG. 5. The first of the two piston grooves is a latching or locking groove 41 and is positioned adjacent the inner end 25 to be engaged by the snap ring 32 when the piston 20 is fully extended to the fixed predetermined position, where groove 41 engages snap ring 32 and thereby locks the piston in this fixed position. The other groove on the piston is the running or retaining groove 43 positioned adjacent the distal end 27 to be engaged by the same snap ring 32 when the piston 20 is in the retracted position. Piston 20 is illustrated in FIG. 4 in the retracted position wherein the snap ring 32 is engaged in the radial running groove 43.

The snap ring 32 is made of a strong resilient material to set into the snap ring groove 33 so that its inner periphery extends into the central hole 30 and more particularly into each of the radial grooves 41 and 43 in the outer wall of the piston. The snap ring 32 is resilient as noted above and also has a gap in its peripheral wall so that it can be deflected deep into the snap ring groove 33 to slide along the exterior of piston 20 and allow the piston 20 to move from the retracted position to the extended position. The snap ring 32 must also be strong to prevent the piston 20 from moving unless a sufficient activation force is imposed on the piston 20 to deflect the snap ring 32 out of the radial running groove 43 and deep into the snap ring groove 33.

Figure 5:
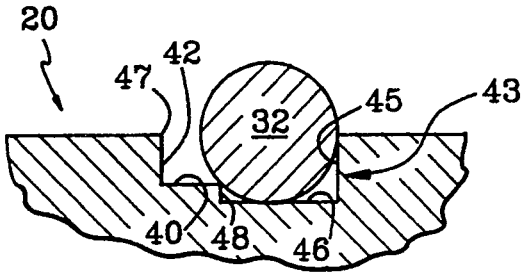
FIG. 5 is a detailed view of a snap ring groove used in the downhole activated centralizer.

Referring to FIG. 5, the radial running groove is shown having a shape that in conjunction with the snap ring 32 allows the piston 20 to move in one direction but not the other. The shape of the groove is also arranged to release the piston for movement to its extended position in response to a relatively precise force being applied to the inner end 25 of the piston. In the direction in which the snap ring 32 allows movement, the snap ring 32 requires an activation or deploying force of a certain magnitude before it will permit the piston 20 to move. The magnitude of the activation or deploying force primarily depends on the spring constant of the snap ring 32, the relevant frictional forces between the snap ring 32 and the piston 20, and the shape of the piston groove 43. In particular, the piston groove 43 has a first vertical face 42 opposed by a second vertical face 45. An example is given herein as to dimensions for these parts of the retaining mechanism, which dimensions have been shown to work where the desired release pressure applied to end 25 of the piston is approximately 1,400 to 1,500 psi.

In the example, faces 42 and 45 are separated 0.090 inches when the snap ring 32 cross-sectional diameter is 0.07 inches. Thus the width of the groove 43 is a total of 0.090 inches and is comprised of a step portion 40 and a deep portion 46. The step portion 40 sits above the deep portion about 0.008 inches or about one fourth the total depth of the grove (face 45) which is about 0.034 inches. The total depth of the groove should be less than one half the thickness of the snap ring. The step 40 is about 0.030 inches long and extends along the bottom far enough to just let the snap ring seat on or touch the bottom of deep portion 46 of the groove.

In trying different configurations of grooves for this activation or retaining groove, whichever way it may be characterized, it was discovered that an upwardly sloped bottom surface 40 in the direction of snap ring movement would sometimes let the snap ring imbed in the softer metal of the groove. This would cause the release to take place usually at a higher pressure than desired, but the release was in the least, unpredictable. A next try involved using a straight wall 42 to total depth of the groove and a flat bottom surface 40, 46. This configuration led to a release pressure that was very dependent on the hardness of the metal forming an edge 47 between the face 42 and the outer cylindrical surface of piston 20 and the shape of the snap ring. The release of the snap ring 32 from the groove depended on the slight deformation of this edge 47 by the harder snap ring in order to start the upward movement of the snap ring from the groove 43. At pressures above about 800 psi this releasing force was unpredictable.

A solution was discovered by using the configuration set forth in FIG. 5 wherein the stepped bottom surface increased the predictability to within about 10 percent at 1,400 psi. 1,000 psi gives more than an adequate margin to permit the casing pipe to be washed down in order to install the pipe in a borehole. The activation pressure of this latter configuration can be changed by adjusting the height of the stepped surface 40. The step starts the upward movement of the snap ring at a more predictable force. A lesser force is required to ride the ring over the top edge 48 of the stepped face between bottom surfaces 40 and 46. The shallower the face 42 and thus the higher the step 40, the less force is required to force the snap ring 32 out of the groove and onto the outer cylindrical surface of the piston 20, to permit the piston to slide within the expanded snap ring to its extended position.

When the travel of the piston reaches its one final extended position, the ring 32 will contract into the groove 41 to latch or lock the piston into its one predetermined fixed extended position. The piston groove 41 is shaped to latch the piston in place so that it will not be moved from this position by forces imposed on the structure in the wellbore. It is important that the piston remain in this extended mode. In this mode, the inner end 25 is substantially clear of the inner bore of casing pipe 60. The chamfered peripheral edge 28 at the distal end 27 of the piston 20 also pushes the snap ring 32 into the snap ring groove 33 when the piston 20 is installed into the central hole 31 in the button 30.

The button 30 further includes a sealing arrangement to provide a pressure tight seal between the piston 20 and the button 30. In particular, the button 30 includes two O-rings 36 and 37 which are positioned on either side of the snap ring 32 in O-ring grooves 34 and 35, respectively. The O-rings 36 and 37 seal against the exterior of the piston 20 to prevent fluids from passing through the central hole 31 in the button 30. The O-rings 36 and 37 must slide along the exterior of the piston 20 passing the piston grooves 41 and 43 while maintaining the pressure tight seal. Accordingly, it is a feature of the preferred embodiment that the spacing of the O-rings 36 and 37 is wider than each of the piston grooves 41, and 43 and spaced apart at a different spacing compared to the spacing of the piston grooves. Therefore, as the piston 20 moves through the central hole 31 from the retracted position to the extended position, one of the O-rings 36 and 37 is in sealing contact with the smooth exterior of the piston 20 while the other may be opposed to one of the piston grooves 41 and 43. Both O-rings 36 and 37 are never juxtaposed to the piston grooves 41 and 43 simultaneously but rather at least one O-ring is in sealing contact with the exterior of the piston 20 at all times.

The piston 20, as noted above, further includes an outwardly tapered peripheral edge 26 at the inner end 25 which serves as a stop against the button 30 to limit the outward movement of the piston 20. The button 30 includes a chamfered edge 39 for engaging the outwardly tapered peripheral edge 26 when the inner end 25 is approximately flush with the inner end of the button 30. Therefore, as arranged, the piston 20 is recessed into the button 30 and substantially clear of the interior bore of the casing 60. A slight dome shape to the inner end 25 of the piston plug 21 may extend slightly into the bore of casing 60, but for all practical purposes the casing bore is considered full opening when the piston is extended and locked.

As noted above, the centralizers 50 are initially provided in the retracted position so that the casing 60 can be run into the well W without the drag and interference of the centralizers 50 extending outwardly. The snap ring 32 is engaged with the running groove 43 to hold the piston in the retracted position until the piston is moved outwardly. As should be noted from the shape of the running groove 43, under normal conditions, the edge 47 of face 42 will not slide past the snap ring 32 and thus the piston is prevented from being moved inwardly into the casing 60 from the retracted position. An activating force or pressure (in the present example 1,400 psi) is required to be applied to the inner end 20 to override the snap ring retaining force.

Once the casing 60 is positioned in the wellbore W for permanent installation, the pistons 20 are deployed to the extended position. A deploying arrangement, as will be discussed below, provides a deploying force on the inner end 25 of each piston 20 to overcome the resistance of the snap ring 32 in running groove 43 and cause the square edge 47 of face 42 of the running groove 43 to push the snap ring 32 into the snap ring groove 33. The deploying force further moves the piston 20 outwardly through the central hole 31 so that the snap ring 32 engages the locking groove 41.

The interaction between the snap ring 32 and the groove 41 is to fully expand into the groove and permanently latch the piston in the extended position. If the distal end 27 of the piston 20 has contacted the wall of the wellbore W, the piston 20 will push the casing away from the wall of the wellbore W to centralize the casing 60.

As illustrated in FIGS. 2 and 3, the casing 60 and centralizers 50 are selected based on the size of the wellbore W so that the pistons 20 may fully extend to the extended position and thereby contact the walls of the borehole around most of the casing 60. Accordingly, during the deployment of the piston 20, the deploying force is expected to move the piston 20 to its fully extended position wherein the snap ring 32 will snap into latching groove 41. Groove 41 is slightly wider than the diameter of the snap ring to permit it to easily contract into the locking groove. The depth of groove 41 is such that the ring 32 will not expand outwardly under forces applied to the ends of the piston.

At about the same time that the snap ring 32 engages the locking groove 41, the outwardly tapered edge 26 at the inner end 25 of the piston 20 engages the chamfered edge 39 of the button 30. Accordingly, once the snap ring 32 snaps into the locking groove 41, the piston 20 cannot extend outwardly farther and cannot be retracted. The locking groove 41 is provided with square edges at both sides to insure a locking action.

The centralizer 50 may be of different embodiments for different functions, in addition to the centralizing function described herein. In the U.S. Pat. No. 5,228,518, embodiments of the centralizer are shown for a variety of functions such as chemical injection, perforating, fracturing and as a production conduit, or for use in combinations of these functions. Thus the bore 29 within the piston 20 may have a shaped charge or tracer material, or the end cap 21 may be made of a material such as aluminum or magnesium which can be readily dissolved with acid.

Figure 6:
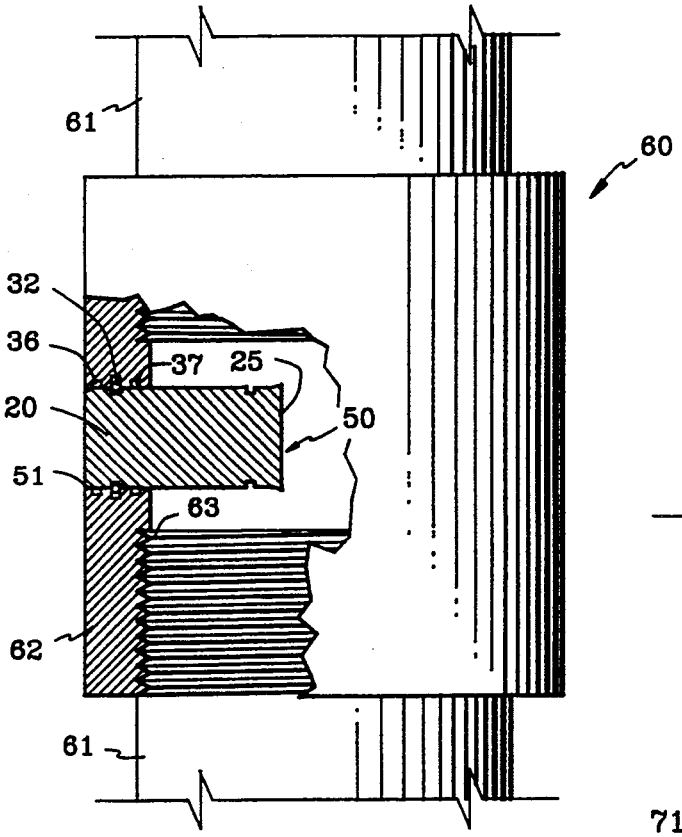
FIG. 6 is a fragmentary cross sectional view of another embodiment of the downhole activated centralizer in a casing collar.

Referring next to FIG. 6 of the drawings, an alternative arrangement is shown wherein the centralizers 50 are mounted in the sidewall of a casing collar 62.

This piston 20 is shown as being solid, having no internal passageway. Other types of pistons as enumerated above could be installed in this embodiment as well. This embodiment does not include a button guide 30 and is directed to an application wherein the centralizers 50 are installed in the collars 62 rather than in the casing pipe 61 itself. The collars 62 connect successive joints of the casing pipe 61 by screw threads 63 as would a conventional collar, but rather than allow the joints 61 to abut one another within the collar 62, the joints 61 are held spaced apart to allow room to receive the centralizing pistons 20 into the interior of the casing string 60 in their retracted position. The piston 20 retains the same exterior shape of the previous embodiments, but the snap ring 32 and the O-rings 36 and 37 have been mounted in a transverse opening 51 which together with O-rings serve as a piston guide in the collar 62. It should be noted that the outer or distal end of the piston 20 is flush with the exterior of the collar 62, therefore being within the maximum exterior outer profile of the casing string 60 while the casing 60 is being run in the wellbore W. This arrangement eliminates the need for the bulbous piston guide, while providing the desired functional characteristic of a full open bore within the casing string and a maximum outer profile no greater than the casing collar.

Figure 7:
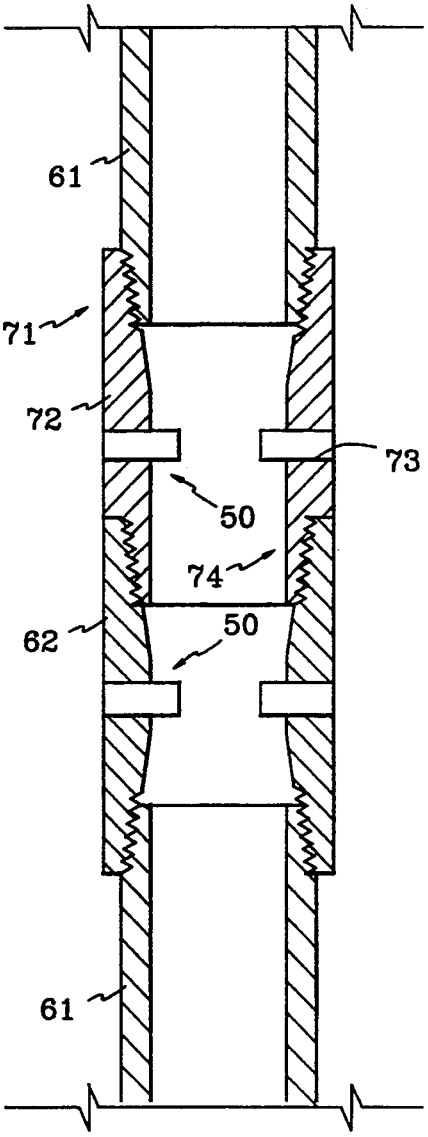
FIG. 7 is a cross sectional view of the downhole activated centralizer in a pup joint.

Referring next to FIG. 7, a small pup joint 71 is shown mounted with centralizers 50. If centralizers are needed only every 40 feet or so, then casing collars or pup joints can be used to house the centralizers. The pup joint 71, which can be made from heavy wall pipe, thus has the advantage of a thick wall portion 72 between the male and female threaded portions on each end of the pup joint 71. As with the collar mounting in FIG. 6, the wall thickness of these pipe portions is sufficient to facilitate mounting of the pistons in openings 73 bored in the wall of pup joint 71. The grooves 36 and 37 for O-ring seals and the snap ring groove 32 (as shown in FIG. 6), are also cut in the opening 73 in the wall 72 but are not shown in FIG. 7. Thus the piston guide in these configurations, or in any situation where the wall thickness will allow, is simply comprised of the opening 73 and the seals and grooves mounted in the opening. Because these pup joints and collars are short in length, the pistons can be inserted from the inside bore of the pipe into the opening 73. The tapered peripheral edge 26 would normally prevent insertion of the piston 20 from the outside of the pipe through the opening 73 unless a button 30 or the like is used as shown in FIG. 4.

Referring again to FIG. 7, one use of the pup joint described above is for when a casing pipe section (normally having male threads on each end when manufactured) is fitted with collars at a manufacturing or supply facility. The collar 62 would normally have female threads on both ends and the collar is assembled to one end of the casing pipe section 61 to protect the exposed male threads on the one end. The collar is made up tight and it is difficult to later remove the collar should it be desired to replace the collar with a collar fitted with extendible centralizers as disclosed above. Thus the pup joint 71 is used to provide centralizers 50 in this situation. The pup joint 71 has its male thread end 74 threaded into the exposed female threads of the preinstalled collar 62. Thus FIG. 7 is shown having such an arrangement of a pup joint 71 joined to a collar 62 between pipe sections 61. In any event, the use of collars 62 and/or the pup joint 71 provides a convenient way to mount centralizing pistons in the pipe string when 40 foot vertical spacing of the centralizers is not a problem.

Figure 8:
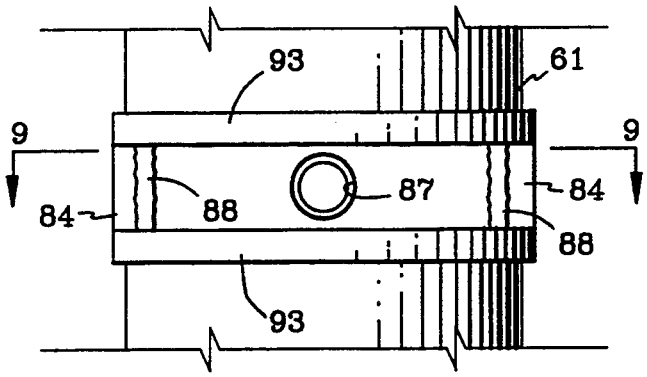
FIG. 8 is a side elevation view of a section of casing having segments applied to the outer casing wall to provide a thick wall for mounting centralizers.
Figure 9:
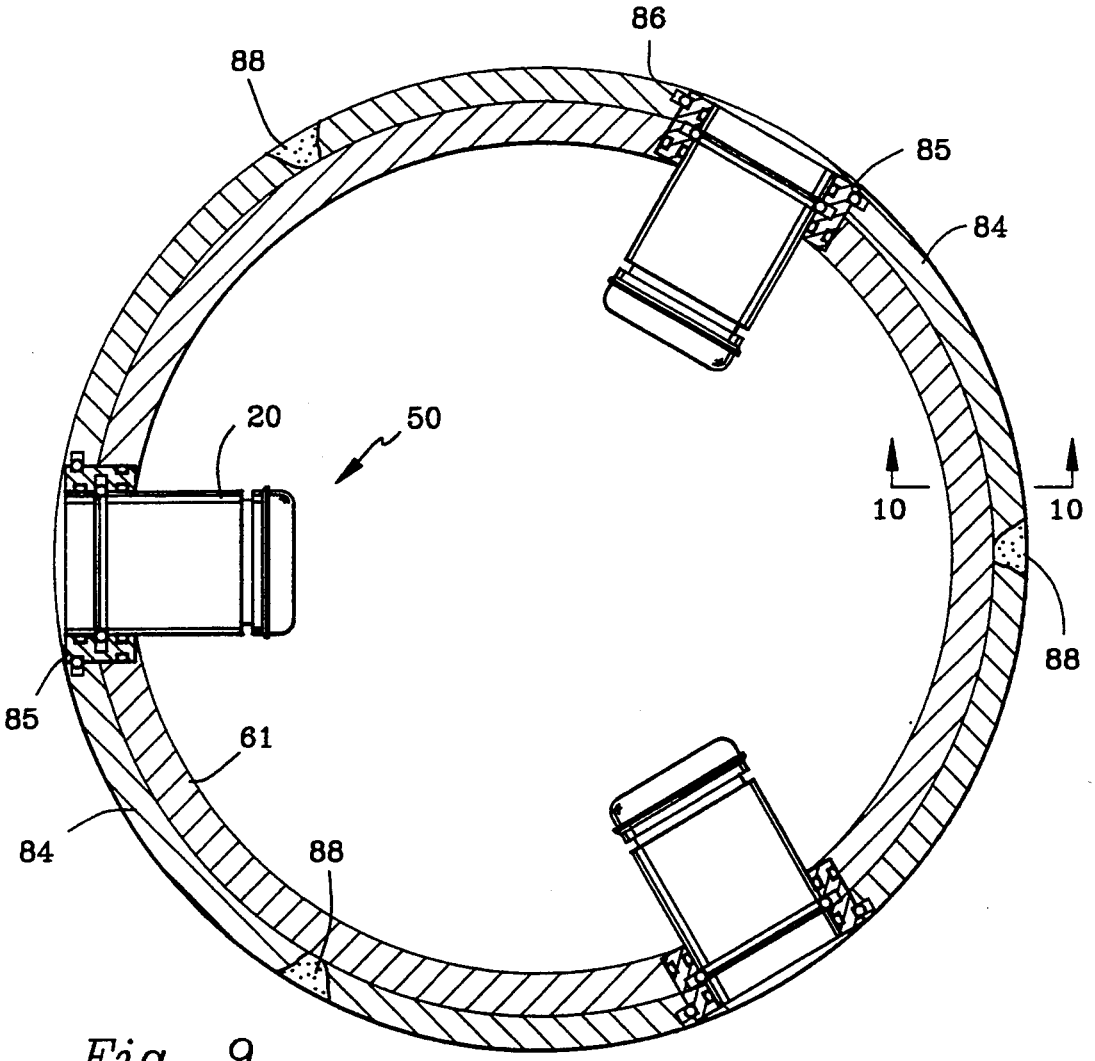
FIG. 9 is a cross sectional plan view taken along lines 9—9 of FIG. 8.
Figure 10:
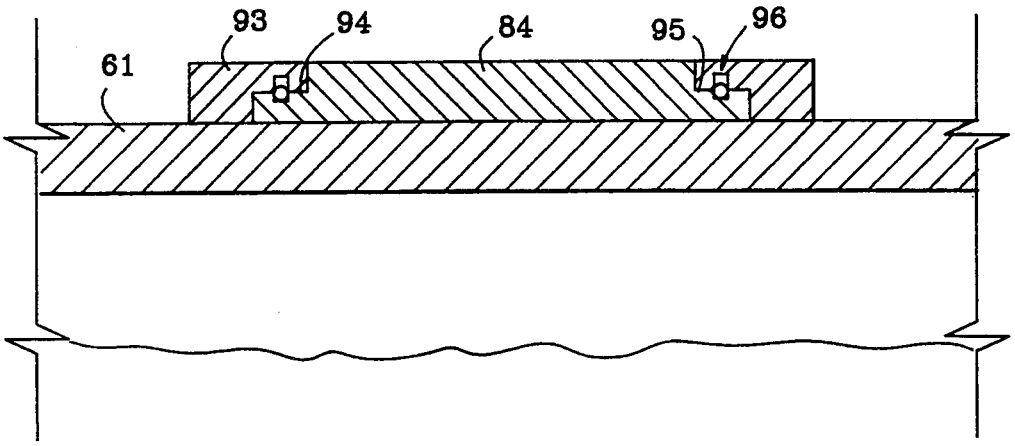
FIG. 10 is a cross sectional view of the casing wall with segments applied taken along lines 10—10 of FIG. 9.

Referring now to FIGS. 8, 9 and 10 of the drawings, an alternative arrangement is shown for providing a pipe wall thickness to facilitate mounting of centralizing pistons in a pipe string. In lieu of the buttons 30 shown in FIG. 4, for extending the wall thickness, FIG. 8 shows the use of ring segments 84 which are fitted to the outer wall surface of the pipe sections 61 and which together with the pipe wall offer a thicker wall section in which to mount piston guides and pistons. A curved segment 84 is made from 120° radial sections of larger diameter pipe material which is of sufficient vertical length along the casing wall to house piston guides. Adjacent segments 84 are also shown in FIG. 8 joined by welds 88. The outer radius of the segments is no greater than the outer radius of the casing collars so that the pistons and guides remain within the maximum exterior profile of the pipe string when mounted flush with the outer surface of the segments 84. FIG. 9, which is a plan view section through FIG. 8, shows the pistons 20 slidably received in piston guide cylinders 85 that are mounted in the combined casing pipe 61 and segment 84 walls. An additional snap ring and groove 86 in the ring segment is used to hold the cylinder 85 in an aligned transverse hole 87 (FIG. 8) formed in the walls of the pipe string 61 and segments 84.

The segments 84 can be held in place on the pipe string by various means including welding, adhesives, screws or the like. However, shown are two preferred methods wherein in FIGS. 8 and 9 a vertical weld 88 is shown between adjacent segments. Also shown in FIGS. 8 and 10 is the use of locking rings 93 which slide over upper and lower shoulders 94 and 95, respectively, at the top and bottom outer edge of segments 84. The rings 93 can be held in place by a groove and snap ring arrangement 96 or may be heated (thereby expanded) and slipped over the shoulders 94, 95 and contracted upon cooling into place thereon.

Referring again to FIG. 1, an activating device 81 is shown in the casing pipe entering the horizontal section. This activating device is in the form of a pump down plug which has a tail portion with elastomeric seals 82 that engage the inner bore of the casing pipe string and form a seal. Thus the device 81 may be run down the pipe string by the application of hydraulic pressure or it may be run on a pipe string or coiled tubing. The front of the plug has a tapered nose portion 85 that tapers into the main body 83 which has an outer diameter just under the size of the casing pipe. The nose portion 85 of the plug 81 engages the inner end 25 (FIG. 4) of the centralizer piston. The enlarged body portion 83 forces the piston outwardly to override the retaining effect of the snap ring 32 to move the piston 20 to an extended position. When the snap ring 32 contracts into locking groove 41, the piston is fixed in a single predetermined extended position. In this position the inner end 25 of the piston is substantially clear of the casing bore except for the dome shaped aluminum end 25 on the plug 21 at the inner end of the piston which extends only a slight distance into the casing bore, say 0.14 inches. This end plug is easily deformed or crushed when the plug 81 passes the inner end of the piston. Any subsequent devices such as bridge plugs or packers can easily pass the inner end of the piston even though this slight portion (up to 0.14 inches) may be extended into the bore so that for all practical purposes the bore is considered full open when the piston is extended. Additionally, aluminum is soft enough that it can be easily knocked off if needed. Since the drilled hole size of the borehole is known, the length of the piston is selected to provide for adequate centralizing of the casing pipe in the hole. It is not necessary for the distal end of all pistons to be in contact with the borehole wall and from a practical standpoint it is likely that they will not all be so engaged. The casing will likely fall to one side of the borehole and the centralizer 50 on that side will engage the borehole wall and push the casing pipe string toward the center of the borehole.

The centralizers 50 may also be deployed by hydraulic pressure in the casing. Accordingly, the casing pressure may be pumped up at the surface closing a valve at the base of the casing string 60 and exceeding the activation or deploying force required to move the pistons from the retracted position to the extended position. Accordingly, the pumps or other pressure creating mechanism would provide the necessary deploying force for the pistons.

In operation and to review the invention, the casing 60 is to be run into a well. It is preferable to have the casing 60 centralized so that an annulus of cement can be injected and set around the entire periphery of the casing to seal the same from the formation. A series of centralizers 50 are installed into the casing 60 such that the pistons are in the retracted position. While in the retracted position, the centralizers 50 are within the maximum outer profile of the casing 60 so as not to interfere with the installation of the casing 60. The centralizers may be installed in certain portions of the casing or may be installed along the entire length thereof and arranged to project from all sides of the casing 60. However, certain centralizers 50 may be predesignated for certain functions. For example, from logging reports and other analysis, it may be decided not to try and produce a certain portion of the formation and the portion of the casing which is expected to coincide with the non-produced portion will be provided with plugs that are solid such as the centralizer 50 in FIG. 6. In an adjacent zone, it might be desirable to perforate the formation with a series of explosive plugs or to establish communication with the formation without perforating the formation. Plugs having sacrificial material may be interspersed along the length of the casing 60. Thus centralizing pistons accommodating those various functions would be installed as shown in the U.S. Pat. No. 5,228,518.

The casing 60 is run into the hole to be located in a suitable place in the wellbore W. Without the conventional externally mounted centralizer equipment, the casing 60 may be rotated and reciprocated to work past tight spots or other interference in the hole. The centralizers 50 further do not interfere with the fluid path through the casing string so that the casing may be circulated to clear cuttings from the end of the casing string. Also the casing could be provided with fluids that are less dense than the remaining wellbore fluids, such as drilling mud, causing the string to float. Clearly, the centralizers 50 of the present invention permit a variety of methods for installing the casing into the desired location in the wellbore W.

Once the casing 60 is in a suitable position, the centralizers are deployed to centralize the casing. As discussed above, there are several methods of deploying the centralizers. The casing may be pressured up by pumps to provide substantial hydraulic force to deploy the pistons. The pistons may not all deploy at once but as the last ones deploy the casing will be moved away from the wall of the wellbore W. Alternatively, a device 81 such as is shown in FIG. 1 may be used to deploy the pistons. The casing in this latter mode of operation would be centralized from the top to bottom. Once the pistons are all deployed and the snap rings have secured them in the extended position such that the pistons are projecting outwardly toward the wall of the wellbore, cement may be injected into the annulus formed by the centralizing of the casing.

The casing 60 may be allowed to set while the production string is assembled and installed into the casing. It is important to note that at this point in the process of establishing the well that the casing and wellbore are sealed from the formation. Accordingly, there is as yet no problem with controlling the pressure of the formation and loss of pressure control fluids into the formation. In a conventional completion process, a perforation string is assembled to create perforations in the casing adjacent the hydrocarbon bearing zone. Accordingly, high density fluids are provided into the wellbore to maintain a sufficient pressure head to avoid a blowout situation. While the production string is assembled and run into the well, some of the fluids will leak into the formation. Unless replacement fluids are provided into the well, the pressure head will decrease until the well becomes unstable. Accordingly, the production string must be installed quickly to begin producing the well once the well has been perforated.

However, with the present invention, such problems are avoided. Once the casing is set in place, the production string may be assembled and installed before the plugs are destroyed. Thus, the process of establishing a well further includes the step of destroying the plugs by acid or by rupturing under pressure or by other means as discussed above.

It should be recognized that this invention has been described for casing in a wellbore for the production of hydrocarbons, which in itself includes many applications. For example, some wells are created for pumping stripping fluids down into the formation to move the oil toward another well which actually produces the oil. Also, the centralized pipe may be run into a larger pipe already set in the ground. For example, on an offshore drilling and production rig, a riser pipe is installed between the platform and the well head at the sea floor. Within the riser pipe other pipes are run which are preferably centralized. The centralizers 50 of the present invention may provide a suitable arrangement for such applications. There are other applications for this centralizing invention which have not been discussed but would be within the scope and spirit of the invention. Accordingly, it should be recognized that the foregoing description and drawings are illustrative of the invention and are provided for explanation and understanding. The scope of the invention should not be limited by the foregoing description and drawings but should be determined by the claims that follow.

We claim:

1. An apparatus for spacing a casing pipe string from the walls of a wellbore wherein the wellbore is established for use in producing hydrocarbons from earth formations, the apparatus comprising:

a plurality of casing pipe sections together with collars making up the casing pipe string;

said collars interconnecting said pipe sections, said collars being comprised of short joints of casing pipe having threads for interconnecting with adjacent ends of pipe sections, said collars further having a greater peripheral wall thickness than said pipe sections, the outside diameter of said collars representing the maximum exterior profile of said pipe string;

a plurality of piston guides in the peripheral wall of said casing pipe string, said piston guides being within the maximum exterior profile of said casing pipe string;

pistons mounted in said piston guides for movement from a retracted position in said piston guides to an extended position wherein the outer end of said pistons are in contact with the wall of the wellbore, the extended position of said pistons being a predetermined single position;

means for deploying said pistons from said retracted position to said predetermined single fixed extended position wherein the inner end of said pistons are substantially clear of an interior bore within said casing pipe string, said piston guides also being substantially clear of the interior bore of said casing pipe string so that when said piston means is in said extended position, said bore in said casing pipe string is substantially fully open.

2. Apparatus for spacing a casing pipe string from the walls of the borehole, comprising:

a plurality of piston guides laterally arranged in the wall of pipe sections making up the casing pipe string, such guides extending between the exterior wall of the casing pipe and a longitudinal bore in the casing pipe;

pistons arranged for sliding movement in said guides from a retracted position, where the outer end of the piston does not extend outwardly beyond the piston guide, to a single predetermined discrete extended position where the outer end of the piston may be moved outwardly from the guide to only one predetermined position;

said guides and retracted pistons being arranged so that they are within the maximum exterior profile of the casing pipe string;

said guides and extended pistons being arranged so that they are substantially clear of the bore in the casing pipe to provide a full opening within the casing pipe bore when said pistons are in said extended position.

3. The apparatus of claim 1 or 2 and further including seal means in said piston guides to provide a fluid seal between said piston guides and said pistons.

4. The apparatus of claim 1 or 2 and further including retaining means in said piston guides for releasably holding said pistons in said retracted position.

5. The apparatus of claim 1 or 2 and further including locking means for holding said piston in said predetermined discrete extended position.

6. The apparatus of claim 1 or 2 and further including latching means in said piston guides, said latching means being arranged to releasably hold said piston in said retracted position and to fixedly hold said piston in only the single extended position.

7. The apparatus of claims 1 or 2 wherein said piston guides are comprised of an opening formed through the peripheral wall of the casing pipe string.

8. The apparatus of claim 2 wherein said casing pipe string includes casing pipe sections, and further including pipe connector means for interconnecting said casing pipe sections, and wherein an outer surface of said connecting means represents the maximum exterior profile of said casing pipe string.

9. The apparatus of claims 1 or 2 wherein pipe segments are applied to the outer wall of the pipe sections and fixed in place thereon to provide a thicker peripheral wall of the casing pipe string so that openings in the wall are sufficiently long to serve as piston guides when the regular pipe section wall thickness is insufficient to serve as said piston guides, said segments having an outer radius which is no greater than the maximum exterior profile of the pipe string.

10. The apparatus of claim 9 wherein pipe segments are applied substantially around the entire wall of the pipe section and are held thereon by circular bands fitted over said segments, wherein the outer radius of said circular bands does not exceed the maximum exterior profile of the pipe string.

11. The apparatus of claim 8 wherein said connector means is comprised of a casing collar.

12. The apparatus of claim 11 wherein said piston guides are comprised of openings extending through the peripheral wall of said connector means.

13. The apparatus of claim 8 wherein said connector means is comprised of a connecting sub which is a joint of pipe that is greater in its outside diameter and peripheral wall thickness than the main body of the pipe section, and wherein said connecting sub has female threads on one end and male threads on the other end, said connecting sub being shorter than a pipe section in length.

14. The apparatus of claim 13 wherein said connecting sub is connected into a casing collar already assembled on a pipe section.

15. The apparatus of claim 14 and further including piston guides and pistons in one or both of said connecting sub and said casing collar.

16. A method for centralizing a casing pipe string from the walls of a wellbore wherein the wellbore is established for use in a well system involved in the production of hydrocarbons from earth formations, wherein the pipe string is provided with transverse piston guides in the walls of the pipe string and pistons are mounted in the piston guides for movement from a retracted position where the outer end of the pistons are inside the piston guide to an extended position where the outer end of the pistons extends outwardly beyond the piston guides toward the wellbore, and wherein the pipe string is made up of casing pipe sections with casing collars interconnecting the pipe sections, the collars having a greater peripheral wall thickness and a greater outside diameter than the pipe sections so that the collars represent the maximum exterior profile of the pipe string, the method comprising;

moving the pistons from said retracted position to said extended position, wherein in the retracted position an inner end of the piston extends into a bore within the pipe string and an outer end of the piston is within the maximum exterior profile of the pipe string, wherein the piston guides are within the maximum exterior profile of the pipe string and do not extend substantially into the bore of the pipe string so that the bore of the pipe string is open when the piston is moved to an extended position, and wherein in the extended position the outer ends of the pistons are moved to a predetermined single position for contact with the wall of the wellbore and the inner end of the piston is substantially clear of the bore of the pipe string to render the bore of the pipe string full open.

17. The method of claim 16 and further including passing a device through the bore of the pipe string to engage the inner end of the piston and thereby move the piston to its extended position.

18. The method of claim 16 and further including fixedly locking the piston in said single predetermined extended position.

19. The method of claim 16 and further mounting at least some of said piston guides and pistons within the casing collars interconnected between pipe sections in the pipe string.

20. The method of claim 16 and further including interconnecting the pipe sections and collars with pup joints, with at least some of the piston guides and pistons being mounted in the pup joints.

21. The method of claim 16 and further including moving the piston from said retracted to an extended position by hydraulic, mechanical or a combination of hydraulic and mechanical forces.

* * * * *